US009534511B2

(12) United States Patent
Lee et al.

(10) Patent No.: US 9,534,511 B2
(45) Date of Patent: Jan. 3, 2017

(54) SWITCHABLE ROCKER ARM WITH IMPROVED SWITCHING RESPONSE TIME

(71) Applicant: DELPHI TECHNOLOGIES, INC., Troy, MI (US)

(72) Inventors: Jongmin Lee, Pittsford, NY (US); Cynthia A. Tawaf, Rochester, NY (US); Ian R. Jermy, Leroy, NY (US); Gregory J. Naber, Victor, NY (US)

(73) Assignee: Delphi Technologies, Inc., Troy, MI (US)

( * ) Notice: Subject to any disclaimer, the term of this patent is extended or adjusted under 35 U.S.C. 154(b) by 136 days.

(21) Appl. No.: 14/289,867

(22) Filed: May 29, 2014

(65) Prior Publication Data

US 2015/0345343 A1 Dec. 3, 2015

(51) Int. Cl.
*F01L 1/34* (2006.01)
*F01L 1/18* (2006.01)

(52) U.S. Cl.
CPC ..... *F01L 1/18* (2013.01)

(58) Field of Classification Search
CPC ..... F01L 1/18
USPC ..... 123/90.16, 90.39
See application file for complete search history.

(56) References Cited

U.S. PATENT DOCUMENTS

| | | | | |
|---|---|---|---|---|
| 5,544,626 | A | 8/1996 | Diggs et al. | |
| 6,186,102 | B1 * | 2/2001 | Kosuge | F01L 1/053 123/90.16 |
| 6,615,782 | B1 * | 9/2003 | Hendriksma | F01L 1/053 123/90.16 |
| 6,925,978 | B1 * | 8/2005 | Gerzseny | F01L 1/18 123/90.16 |
| 7,761,217 | B2 | 7/2010 | Waters et al. | |
| 2009/0078225 | A1 | 3/2009 | Hendriksma | |

* cited by examiner

*Primary Examiner* — Zelalem Eshete
(74) *Attorney, Agent, or Firm* — Joshua M. Plaines

(57) ABSTRACT

A rocker arm includes a follower which follows a first lobe of a camshaft and is mounted to a rocker arm body; a lock pin that is selectively moveable in a lock bore between a first position and a second position in order to prevent relative movement between the rocker arm body and the follower in one of the first position and the second position and to permit relative movement between the rocker arm body and the follower in the other of the first position and the second position; and a rocker arm oil passage in fluid communication with the lock bore for communicating oil therethrough to move the lock pin between the first position and the second position. The rocker arm oil passage is elongated in a circumferential direction relative to the lock bore.

10 Claims, 5 Drawing Sheets

SWITCHABLE ROCKER ARM WITH IMPROVED SWITCHING RESPONSE TIME

TECHNICAL FIELD OF INVENTION

The present invention relates to a rocker arm for transmitting opening and closing motion from a camshaft to a combustion valve of an internal combustion engine; more particularly to such a rocker arm which is switchable between a high lift mode and a low lift mode; and even more particularly to an oil passage for supplying and draining oil to and from a locking mechanism which switches the rocker arm between the high lift mode and the low lift mode.

BACKGROUND OF INVENTION

It is known in the art of internal combustion engines to provide variable valve actuation devices which are switchable between a low lift mode and high lift mode, thereby opening a combustion valve, for example an intake valve, to a low lift and a high lift respectively. One such variable valve actuation device is disclosed in United States Patent Application Publication No. US 2009/0078225 to Hendriksma, hereinafter referred to as Hendriksma, the disclosure of which is incorporated herein by reference in its entirety. Hendriksma teaches a rocker arm with a rocker arm body within which is mounted a center high lift follower which is selectively allowed to pivot relative to the rocker arm body. A pair of low lift followers are mounted to the rocker arm body and flank the high lift follower. The high lift follower follows a high lift lobe of a camshaft to selectively transmit high valve lifting motion to a combustion valve while the low lift followers follow respective low lift lobes of the camshaft to selectively transmit low valve lifting motion to the combustion valve.

A locking mechanism is provided to selectively allow the high lift follower to pivot relative to the rocker arm body and to selectively prevent the high lift follower from pivoting relative to the rocker arm body. In order to position the locking mechanism to prevent the high lift follower from pivoting relative to the rocker arm body, thereby allowing high valve lifting motion to be transmitted to the combustion valve from the high lift lobe, pressurized oil is supplied to the locking mechanism through a circular oil passage originating in a rocker arm socket within which a tip of a lash adjuster is received. The pressurized oil urges a lock pin into engagement with the high lift follower.

Conversely, in order to position the locking mechanism to allow the high lift follower to pivot relative to the rocker arm body, thereby allowing low valve lifting motion to be transmitted to the combustion valve from the low lift lobes, oil is drained from the locking mechanism through the oil passage originating in the socket, and a lock spring pushes the lock pin out of engagement with the high lift follower. Consequently, the high lift lobe causes the high lift follower to pivot cyclically within the rocker arm body.

The rocker arm of Hendriksma is considered to be a default low lift two-step rocker arm because the rocker arm is placed in the low lift mode when no pressurized oil is supplied to the locking mechanism. It is known to provide a two-step rocker arm similar to the rocker arm of Hendriksma with the exception of modifying the locking mechanism to place the rocker arm in the high lift mode when pressurized oil is not supplied to the locking mechanism, thereby resulting in a default high lift two-step rocker arm. Such a modified locking mechanism is disclosed in FIG. 2 of U.S. Pat. No. 7,761,217 to Waters et al., hereinafter referred to as Waters, the disclosure of which is incorporated herein by reference in its entirety.

In order to allow the locking mechanisms of Hendriksma and Waters to respond sufficiently quickly to a desire to change operational positions, the oil passage must be sufficiently large to communicate oil therethrough in a sufficiently small amount of time. However, due to packaging constraints of the rocker arm, it may not be possible to increase the diameter of the oil passage without also increasing the size of other features of the rocker arm which also increases the overall packaging size of the rocker arm. Consequently, in the prior art, a compromise must be made between the packaging size of the rocker arm and the time required for responding to a change in operational positions of the locking mechanism. Furthermore, the response time of the lock pin can be sensitive to the circumferential orientation of the lash adjuster in the internal combustion engine due to misalignment of an oil inlet of the lash adjuster with the oil supply of the internal combustion engine.

What is needed is a rocker arm which minimizes or eliminates one or more of the shortcomings as set forth above.

SUMMARY OF THE INVENTION

Briefly described a rocker arm is provided for transmitting opening and closing motion from a camshaft of an internal combustion engine to a combustion valve of the internal combustion engine. The rocker arm includes a follower which follows a first lobe of the camshaft and is mounted to a rocker arm body. The rocker arm also includes a lock pin that is selectively moveable along an axis in a lock bore between a first position and a second position in order to prevent relative movement between the rocker arm body and the follower in one of the first position and the second position and to permit relative movement between the rocker arm body and the follower in the other of the first position and the second position. The rocker arm also includes a rocker arm oil passage in fluid communication with the lock bore for communicating oil in use through the rocker arm oil passage to move the lock pin between the first position and the second position. The rocker arm oil passage is elongated in a circumferential direction relative to the lock bore. Elongating the rocker arm oil passage in a circumferential direction relative to the lock bore allows oil flow therethrough to be maximized in order to move the lock pin between the first position and the second position sufficiently quickly while minimizing the packaging size of the rocker arm.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
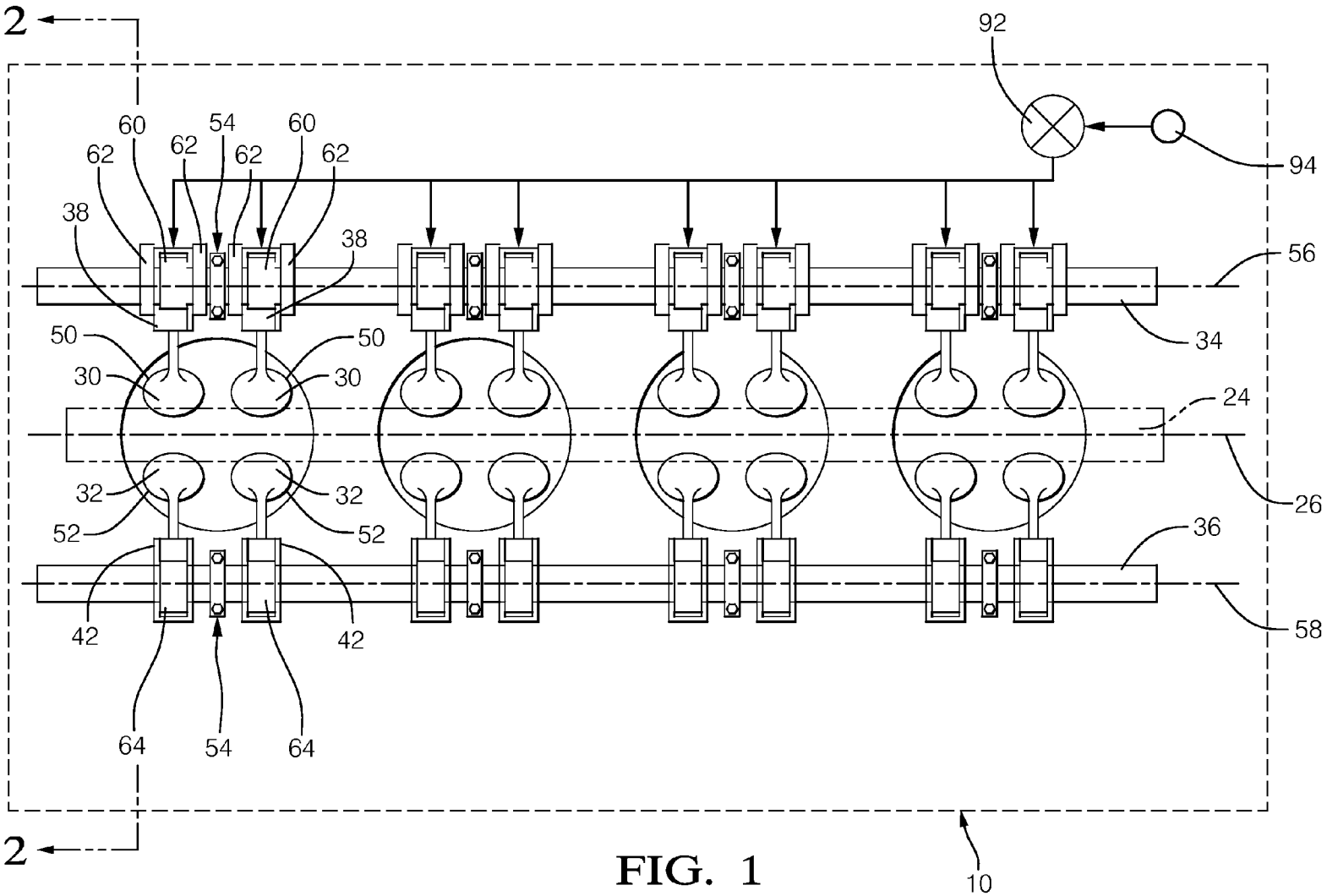
FIG. 1 is a schematic drawing of an internal combustion engine which includes a rocker arm in accordance with the present invention.
Figure 2:
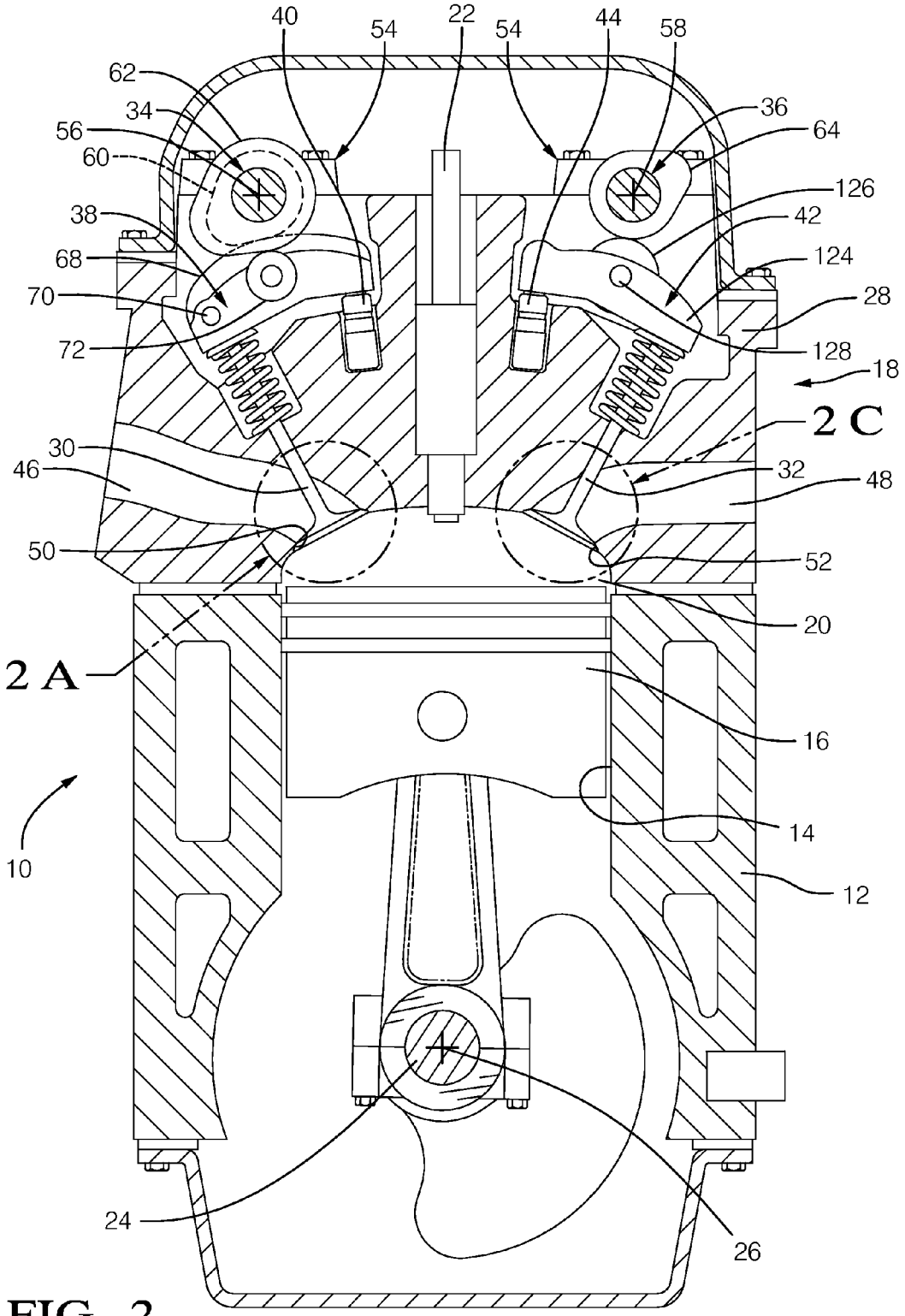
FIG. 2 is an elevation cross-sectional view of the internal combustion engine of FIG. 1 taken through section line 2-2.

In accordance with a preferred embodiment of this invention and referring to FIGS. 1 and 2, an internal combustion engine 10 with an engine block 12 is shown. As shown, internal combustion engine 10 is a multi-cylinder engine, however, for brevity, only one cylinder 14 defined by engine block 12 and the components and features relating to cylinder 14 will be described since cylinder 14 is substantially the same as the others. A piston 16 is reciprocatable within cylinder 14 and a cylinder head assembly 18 is mounted to engine block 12 such that a combustion chamber 20 is defined between piston 16 and cylinder head assembly 18. A fuel injector 22 may be provided for injecting fuel directly into combustion chamber 20 for combustion of the fuel within combustion chamber 20 which causes piston 16 to reciprocate within combustion chamber 20. A lower end of piston 16 is attached to a crankshaft 24 which rotates about a crankshaft axis 26 as a result of reciprocation of piston 16 within combustion chamber 20. Cylinder head assembly 18 selectively allows air into combustion chamber 20 to support combustion of the fuel and selectively allows exhaust gases out of combustion chamber 20 that result from the combustion of the fuel. Alternatively, but not shown, fuel injector 22 may inject fuel upstream of combustion chamber 20 such that the fuel is introduced into combustion chamber 20 along with air that is supplied by cylinder head assembly 18. A spark plug (not shown) may be provided to initiate combustion of the fuel within combustion chamber 20. Internal combustion engine 10 may be an in-line four cylinder engine as shown; however, it should be understood that a greater or lesser number of cylinders may be included and other cylinder arrangements may be used, for example only, an internal combustion engine having banks of cylinders arranged at an angle to each other which are commonly known as "V" configurations.

Cylinder head assembly 18 generally includes a cylinder head 28 fastened to engine block 12; an intake valve 30 mounted within cylinder head 28; an exhaust valve 32 mounted within cylinder head 28; an intake camshaft 34 mounted within cylinder head 28; an exhaust camshaft 36 mounted within cylinder head 28; an intake rocker arm 38 engaged with intake camshaft 34 and intake valve 30 and pivotable about an intake lash adjuster 40; an exhaust rocker arm 42 engaged with exhaust camshaft 36 and exhaust valve 32 and pivotable about an exhaust lash adjuster 44. Cylinder head assembly 18 will be described in greater detail in the paragraphs that follow. As illustrated, cylinder 14 includes respective pairs of intake valves 30, exhaust valves 32, intake rocker arms 38, intake lash adjusters 40, exhaust rocker arms 42, and exhaust lash adjusters 44; however, it should be understood that each cylinder 14 may include different numbers of each depending on the design of internal combustion engine 10.

Figure 2A:
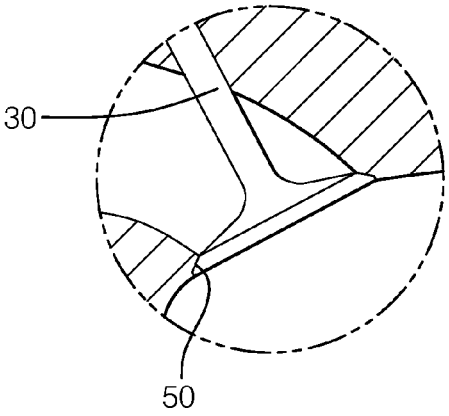
FIG. 2A is an enlarged view of an intake valve and an intake valve seat of FIG. 2 shown in the intake closed position.
Figure 2B:
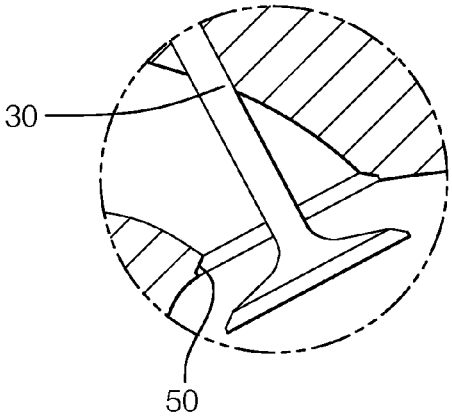
FIG. 2B is an enlarged view of the intake valve and the intake valve seat of FIG. 2 shown in the intake open position.
Figure 2C:
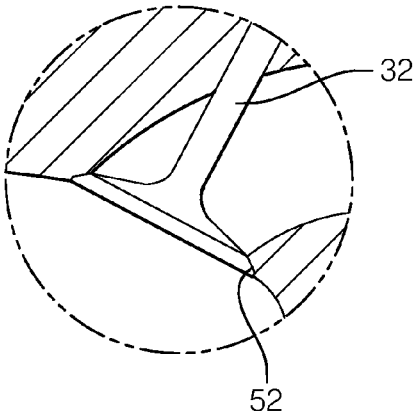
FIG. 2C is an enlarged view of an exhaust valve and an exhaust valve seat of FIG. 2 shown in the exhaust closed position.
Figure 2D:
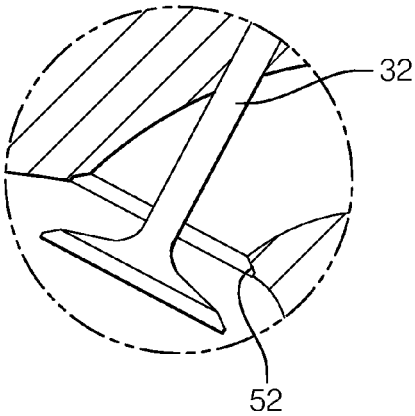
FIG. 2D is an enlarged view of the exhaust valve and the exhaust valve seat of FIG. 2 shown in the exhaust open position.

Cylinder head 28 defines an air intake port 46 for selectively communicating air to combustion chamber 20, an exhaust port 48 for selectively discharging exhaust gases from combustion chamber 20, an intake valve seat 50 between air intake port 46 and combustion chamber 20, and an exhaust valve seat 52 between exhaust port 48 and combustion chamber 20. Intake valve 30 is selectively seated (FIG. 2A) and unseated (FIG. 2B) in a cyclic pattern with intake valve seat 50 via input from intake camshaft 34 and intake rocker arm 38 as will be discussed in greater detail below. Similarly, exhaust valve 32 is selectively seated (FIG. 2C) and unseated (FIG. 2D) in a cyclic pattern with exhaust valve seat 52 via input from exhaust camshaft 36 and exhaust rocker arm 42 as will be discussed in greater detail below.

Intake camshaft 34 and exhaust camshaft 36 are mounted within cylinder head 28 via a plurality of camshaft bearings 54. In this way, intake camshaft 34 rotates about an intake camshaft axis 56 and exhaust camshaft 36 rotates about an exhaust camshaft axis 58 via input from crankshaft 24 through a drive member (not shown), which may be, for example only, a chain, belt, or gear arrangement.

Intake camshaft 34 includes a center high lift intake lobe 60 flanked by a pair of outer low lift intake lobes 62. High lift intake lobe 60 selectively transmits a high lift valve opening and closing motion to intake valve 30 through intake rocker arm 38 as will be described in greater detail later while low lift intake lobes 62 selectively transmit a low lift valve opening and closing motion to intake valve 30 through intake rocker arm 38 as will also be described in greater detail later. The high lift valve opening and closing motion as used herein is meant to be a motion that will open intake valve 30 a greater magnitude from intake valve seat 50 than the low lift valve opening and closing motion. As used herein, low lift also encompasses no lift as may be desirable in cylinder deactivation arrangements where selective cylinders of internal combustion engine 10 may be deactivated during periods of low power output demands of internal combustion engine 10. Consequently, low lift intake lobes 62 may be circular in order to prevent motion from being imparted on intake valve 30.

Exhaust camshaft 36 includes an exhaust lobe 64 which transmits valve opening and closing motion to exhaust valve 32 through exhaust rocker arm 42 as will be described in greater detail later.

Figure 3:
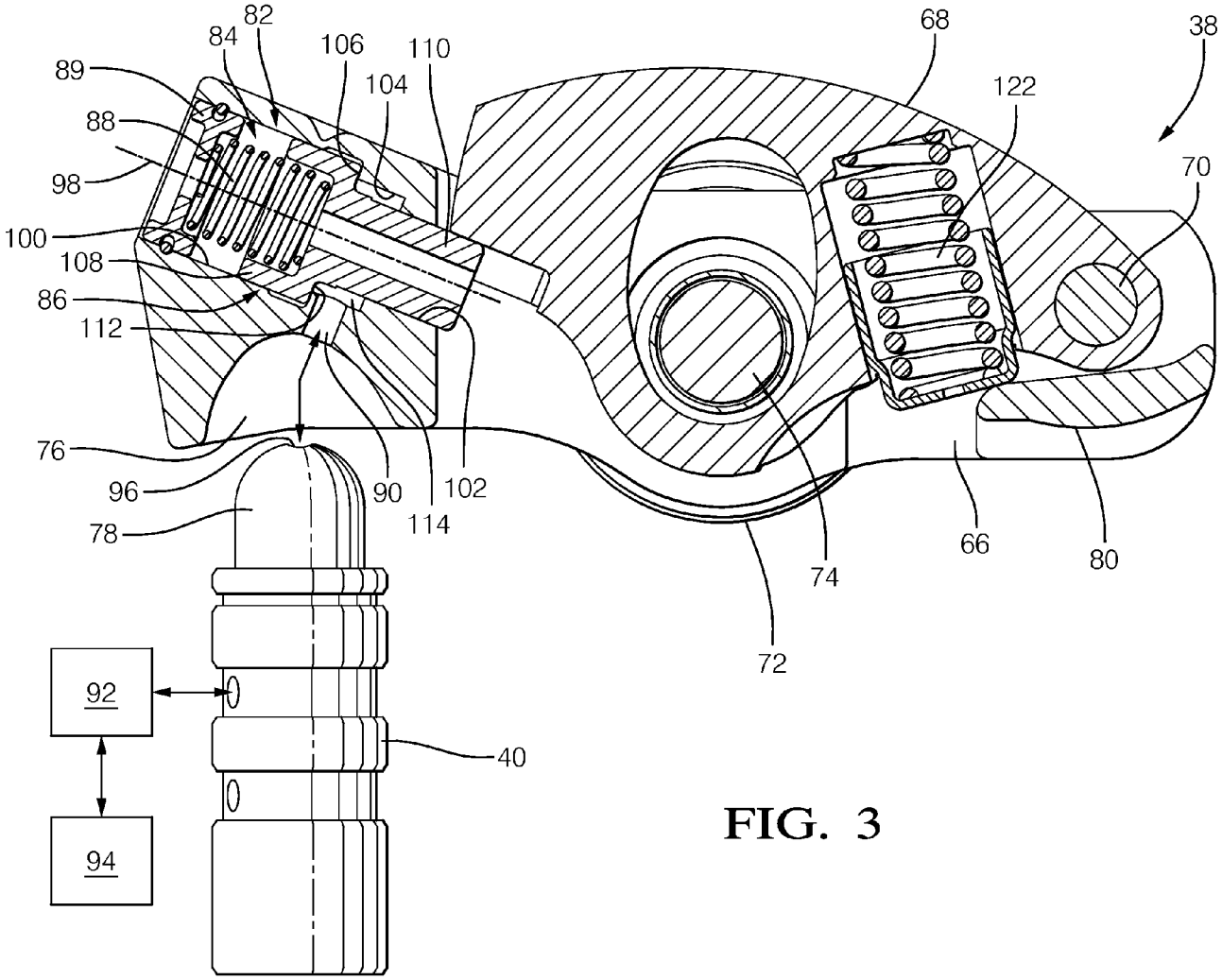
FIG. 3 is a cross-sectional view of the rocker arm in accordance with the present invention.

With continued reference to FIGS. 1 and 2 and now with additional reference to FIG. 3, intake rocker arm 38 will be described where intake rocker arm 38 is a switchable rocker arm to provide different magnitudes of valve lift to intake valve 30. Intake rocker arm 38 includes an intake rocker arm body 66 within which is mounted a center high lift follower 68 which is selectively pivotable within intake rocker arm body 66 about a pivot shaft 70. High lift follower 68 follows high lift intake lobe 60 of intake camshaft 34 in a sliding interface. A pair of low lift followers 72, illustrated as rollers which flank high lift follower 68, are mounted to intake rocker arm body 66 on a roller shaft 74. Each low lift follower 72 follows a respective low lift intake lobe 62 of intake camshaft 34 in a rolling interface. A first end of intake rocker arm body 66 defines a rocker arm socket 76 which engages and pivots about an intake lash adjuster tip 78 of intake lash adjuster 40 while a second end defines a valve engaging surface 80 which engages intake valve 30, thereby causing intake valve 30 to seat and unseat with intake valve seat 50 as intake rocker arm 38 pivots about intake lash adjuster 40. Intake lash adjuster tip 78 may be substantially hemispherical in shape as shown while rocker arm socket 76 may be concave and dome-shaped as shown, but enlarged compared to intake lash adjuster tip 78 to allow articulation between intake rocker arm 38 and intake lash adjuster 40.

A locking mechanism 82 is disposed within intake rocker arm body 66 at the end thereof which engages intake lash adjuster 40. Locking mechanism 82 includes a lock bore 84 in intake rocker arm body 66 within which a lock pin 86 is slidably disposed. Lock pin 86 selectively engages high lift follower 68, thereby preventing relative movement between high lift follower 68 and intake rocker arm body 66. Lock pin 86 also selectively disengages high lift follower 68, thereby allowing high lift follower 68 to pivot relative to intake rocker arm body 66 about pivot shaft 70. Locking mechanism 82 also includes a lock spring 88 which urges lock pin 86 into engagement with high lift follower 68 when high lift of intake valve 30 is desired. Lock spring 88 is grounded to intake rocker arm body 66 by a lock pin stop 89 which is fixed within lock bore 84, for example only, by press fit and/or a retaining ring. Lock spring 88 is captured axially between lock pin stop 89 and lock pin 86. Conversely, pressurized oil is supplied to lock pin 86 through a rocker arm oil passage 90 which extends from rocker arm socket 76 to lock bore 84, thereby compressing lock spring 88 and disengaging lock pin 86 from high lift follower 68 when low lift of intake valve 30 is desired. The supply of pressurized oil to lock pin 86 may be controlled, for example, by an oil control valve 92 which receives oil from an oil supply 94 of internal combustion engine 10. From oil control valve 92, the oil is communicated to intake lash adjuster 40 where the oil is passed out of intake lash adjuster tip 78 through an intake lash adjuster oil passage 96. The oil leaving intake lash adjuster oil passage 96 lubricates the interface between intake lash adjuster tip 78 and rocker arm socket 76. Consequently, when lock pin 86 is desired to engage high lift follower 68 under the force of lock spring 88, oil control valve 92 is operated to supply oil at a pressure that is not sufficient to compress lock spring 88 with lock pin 86 but still sufficient to provide lubrication to the interface between intake lash adjuster tip 78 and rocker arm socket 76. Conversely, when lock pin 86 is desired to be disengaged from high lift follower 68, oil control valve 92 is operated to supply oil at a pressure that is sufficient to compress lock spring 88 with lock pin 86. In this way, the interface between intake lash adjuster tip 78 and rocker arm socket 76 is lubricated under all operating conditions.

Lock bore 84 is centered about an axis 98 and defined by three distinct sections, namely a lock bore first section 100 that is distal from high lift follower 68, a lock bore second section 102 that is proximal to high lift follower 68, and a lock bore third section 104 that is coaxial with, and axially between, lock bore first section 100 and lock bore second section 102. Lock bore first section 100 is larger in diameter than lock bore third section 104, thereby defining a lock bore shoulder 106 where lock bore first section 100 meets lock bore third section 104 such that lock bore shoulder 106 limits the extent to which lock pin 86 is able to travel toward high lift follower 68. Lock bore second section 102 is smaller in diameter than both lock bore first section 100 and lock bore third section 104.

Lock pin 86 is defined by two distinct sections, namely a lock pin piston section 108 which is disposed within lock bore first section 100 and a lock pin locking section 110 which is disposed within lock bore second section 102 and lock bore third section 104 under all operating conditions and is also disposed within lock bore first section 100 when lock pin 86 is not engaged with high lift follower 68. Lock pin piston section 108 is sized to fit within lock bore first section 100 in a close sliding fit such that oil is substantially prevented from passing between the interface of lock pin piston section 108 and lock bore first section 100, radial movement of lock pin piston section 108 within lock bore first section 100 is substantially prevented, and lock pin piston section 108 is allowed to move along axis 98 within lock bore first section 100 substantially uninhibited. Lock pin locking section 110 is sized to fit within lock bore second section 102 in a close sliding fit such that oil is substantially prevented from passing between the interface of lock pin locking section 110 and lock bore second section 102, radial movement of lock pin locking section 110 is substantially prevented, and lock pin locking section 110 is allowed to move along axis 98 within lock bore second section 102 substantially uninhibited. Consequently, a lock pin shoulder 112 is defined between lock pin piston section 108 and lock pin locking section 110, thereby providing a surface for oil to act upon and also providing a surface to abut lock bore shoulder 106 to limit travel of lock pin 86 toward high lift follower 68. Conversely, the travel of lock pin 86 away from high lift follower 68 is limited by lock pin stop 89. Since lock bore third section 104 is larger in diameter than lock bore second section 102, an annular pressure chamber 114 is defined radially between lock pin locking section 110 and lock bore third section 104. Rocker arm oil passage 90 enters lock bore 84 at lock bore third section 104 such that rocker arm oil passage 90 is located entirely between lock bore first section 100 and lock bore second section 102 in order for the oil to be supplied to pressure chamber 114 and have access to lock pin shoulder 112. In order to keep the size of rocker arm body minimized for packaging in internal combustion engine 10, it may be desirable to keep the length of lock bore third section 104 along axis 98 as small as possible. It is known in the prior art to form the rocker arm oil passage as a cylinder since it is relatively easy and inexpensive to form the rocker arm oil passage by drilling. However, the diameter of the rocker arm oil passage in the prior art is limited by the length of lock bore third section 104 along axis 98. If rocker arm oil passage 90 is not sufficiently sized, oil may not be able to enter and exit pressure chamber 114 sufficiently fast in order to engage or disengage lock pin 86 with high lift follower 68 in a time period that is satisfactory for operation of internal combustion engine 10. Consequently, in accordance with the present invention, rocker arm oil passage 90 is provided to minimize the length of lock bore third section 104 along axis 98 while allowing sufficient flow of oil through rocker arm oil passage 90 in order to minimize the time taken to engage or disengage lock pin 86 with high lift follower 68.

Figure 4:
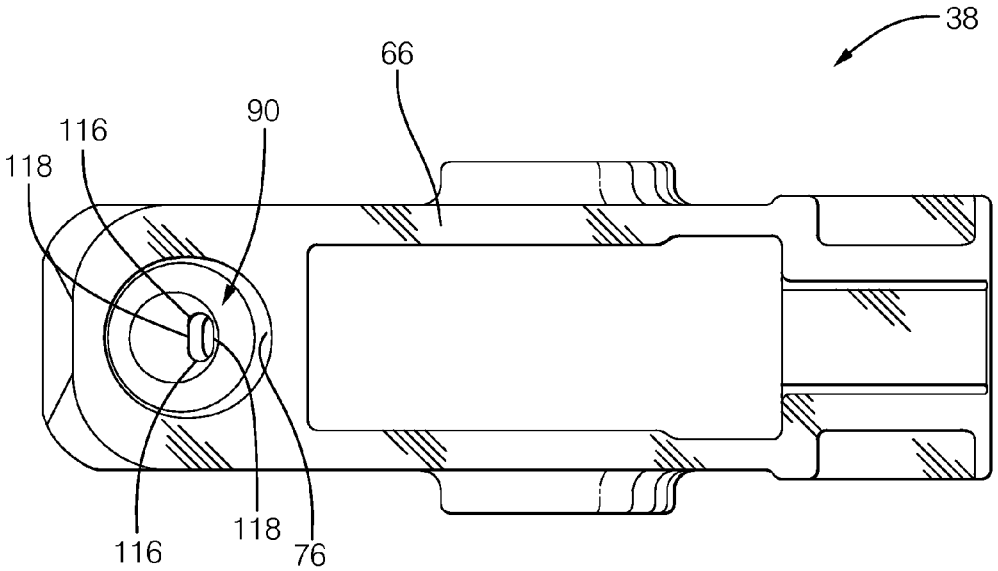
FIG. 4 is an elevational view of a rocker arm oil passage of a rocker arm body of the rocker arm in accordance with the present invention.

In a first embodiment as shown in FIG. 4, rocker arm oil passage 90 is elongated in a circumferential direction around lock bore third section 104. As shown, rocker arm oil passage 90 is non-circular and includes opposing semicircular end walls 116 which are connected by opposing substantially straight sidewalls 118. Rocker arm oil passage 90 may be formed, by way of non-limiting example only, by milling, electrical discharge machining (EDM), or punching. In this way, rocker arm oil passage 90 allows the length of lock bore third section 104 along axis 98 to be minimized while allowing sufficient flow of oil through rocker arm oil passage 90 to minimize the time taken to engage or disengage lock pin 86 with high lift follower 68. Rocker arm oil passage 90 also decreases the sensitivity of the circumferential orientation of the intake lash adjuster 40 in internal combustion engine 10. While rocker arm oil passage 90 has been shown and described as including opposing semicircular end walls 116 which are connected by opposing substantially straight sidewalls 118, it should now be understood that rocker arm oil passage 90 may take other shapes which may be, by way of non-limiting example only, an ellipse or a rectangle.

Figure 5:
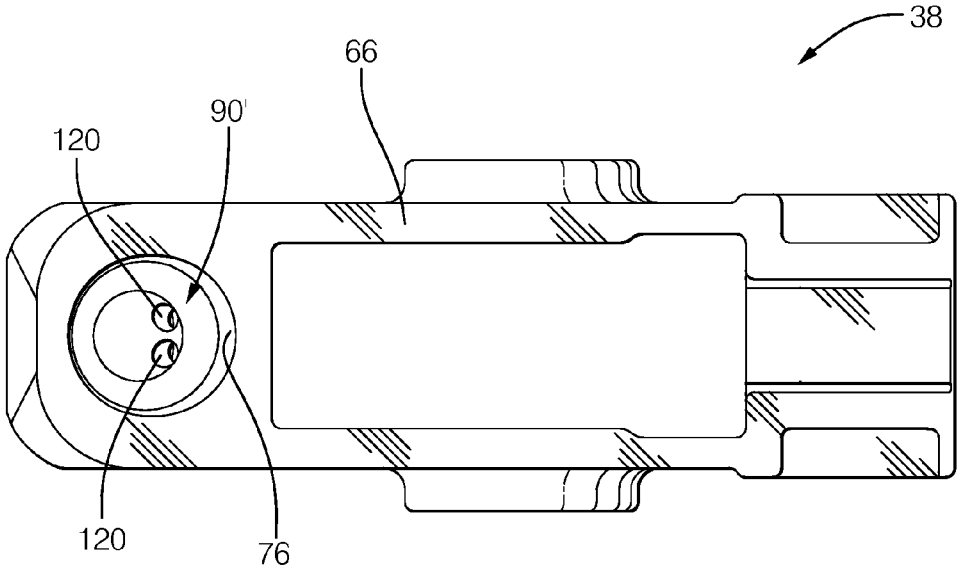
FIG. 5 is an elevational view of an alternative rocker arm oil passage of the rocker arm body of the rocker arm in accordance with the present invention.

In a second embodiment as shown in FIG. 5, rocker arm oil passage 90 is replaced with rocker arm oil passage 90' which is defined by two oil passages 120 that may each be cylindrical as shown. Oil passages 120 are spaced circumferentially about lock bore third section 104, and consequently, rocker arm oil passage 90' is elongated in a circumferential direction around lock bore third section 104. Like rocker arm oil passage 90 described above, rocker arm oil passage 90' allows the length of lock bore third section 104 along axis 98 to be minimized while allowing sufficient flow of oil through rocker arm oil passage 90 to minimize the time taken to engage or disengage lock pin 86 with high lift follower 68. However, since rocker arm oil passage 90' is defined by oil passages 120 that are cylindrical, rocker arm oil passage 90' may be formed, for example only, by drilling which may be less complex and less costly. While rocker arm oil passage 90' has been described and illustrated as being defined by two oil passages 120, it should now be understood that more than two oil passages 120 may be provided, depending on the flow requirement needed to engage or disengage lock pin 86 with high lift follower 68. Furthermore, while oil passages 120 have been described and illustrated as being cylindrical, it should now be understood that oil passages 120 may be non-cylindrical, for example only, the shape of rocker arm oil passage 90 as described above.

Again with reference to FIG. 3, a lost motion spring 122, illustrated for example only as a compression coil spring, is disposed operatively between high lift follower 68 and intake rocker arm body 66. When lock pin 86 is disengaged from high lift follower 68, lost motion spring 122 is compressed and uncompressed in a cyclic pattern by high lift intake lobe 60. In this way, lost motion spring 122 maintains contact between high lift follower 68 and high lift intake lobe 60 while not permitting valve lifting motion to be transferred from high lift intake lobe 60 to intake valve 30.

Further features and characteristics of intake rocker arm 38 are shown in United States Patent Application Publication No. 2009/0078225 to Hendriksma and U.S. Pat. No. 7,761,217 to Waters et al. which are incorporated herein by reference in their entirety.

Again with reference to FIGS. 1 and 2, exhaust rocker arm 42 includes an exhaust rocker arm body 124 within which an exhaust rocker arm follower 126 is mounted on a roller shaft 128. Exhaust rocker arm follower 126, illustrated as a roller, follows exhaust lobe 64 of exhaust camshaft 36 in a rolling interface. A first end of exhaust rocker arm body 124 engages and pivots about exhaust lash adjuster 44 while a second end engages exhaust valve 32 thereby causing exhaust valve 32 to seat and unseat with exhaust valve seat 52 as exhaust rocker arm 42 pivots about exhaust lash adjuster 44 as a result of exhaust lobe 64. As shown, exhaust rocker arm 42 is a conventional rocker arm which provides only one magnitude of lift, however, it should be understood that exhaust rocker arm 42 may be configured to be a two-step rocker arm as has been illustrated by intake rocker arm 38.

While intake rocker arm 38 has been illustrated as defaulting to the high lift mode, i.e. high lift follower 68 is prevented from pivoting relative to intake rocker arm body 66 when oil pressure is insufficient to move lock pin 86 to compress lock spring 88, it should now be understood that intake rocker arm 38 may be arranged to default to the low lift mode, i.e. high lift follower 68 is permitted to pivot relative to intake rocker arm body 66.

While high lift follower 68 has been illustrated as being a sliding interface with high lift intake lobe 60, it should now be understood that high lift follower 68 may alternatively be a rolling interface with high lift intake lobe 60. Similarly, while low lift followers 72 have been illustrated as being a rolling interface with low lift intake lobes 62, it should now be understood that low lift followers 72 may alternatively be a sliding interface with low lift intake lobes 62.

While this invention has been described in terms of preferred embodiments thereof, it is not intended to be so limited, but rather only to the extent set forth in the claims that follow.

We claim:

1. A rocker arm for transmitting opening and closing motion from a camshaft of an internal combustion engine to a combustion valve of said internal combustion engine, said rocker arm comprising:

a follower which follows a first lobe of said camshaft and is mounted to a rocker arm body;

a lock pin selectively moveable along an axis in a lock bore between a first position and a second position in order to prevent relative movement between said rocker arm body and said follower in one of said first position and said second position and to permit relative movement between said rocker arm body and said follower in the other of said first position and said second position;

a rocker arm oil passage in fluid communication with said lock bore for communicating oil in use through said rocker arm oil passage to move said lock pin between said first position and said second position, wherein said rocker arm oil passage is elongated in a circumferential direction relative to said lock bore; and a rocker arm socket in said rocker arm body for receiving a lash adjuster of said internal combustion engine, wherein said rocker arm oil passage extends between said rocker arm socket and said lock bore;

wherein said lock bore comprises:

a lock bore first section that is distal from said follower;

a lock bore second section that is proximal to said follower and has a different diameter than said lock bore first section; and a lock bore third section that is coaxial with, and axially between, said lock bore first section and said lock bore second section and said lock bore third section has a diameter that is different than said lock bore first section and said lock bore second section;

wherein said rocker arm oil passage is located entirely between said lock bore first section and said lock bore second section.

2. A rocker arm as in claim 1 wherein:

said lock bore third section is smaller in diameter than said lock bore first section and;

said lock bore third section is larger in diameter than said lock bore second section.

3. A rocker arm as in claim 1 wherein said rocker arm oil passage is non-circular.

4. A rocker arm as in claim 3 wherein said rocker arm oil passage is defined by opposing semicircular end walls which are connected by opposing substantially straight sidewalls.

5. A rocker arm as in claim 1 wherein said rocker arm oil passage is defined by two or more cylindrical oil passages.

6. A rocker arm for transmitting opening and closing motion from a camshaft of an internal combustion engine to a combustion valve of said internal combustion engine, said rocker arm comprising:

a follower which follows a first lobe of said camshaft and is mounted to a rocker arm body;

a lock pin selectively moveable along an axis in a lock bore between a first position and a second position in order to prevent relative movement between said rocker arm body and said follower in one of said first position and said second position and to permit relative movement between said rocker arm body and said follower in the other of said first position and said second position;

a rocker arm oil passage in fluid communication with said lock bore for communicating oil in use through said rocker arm oil passage to move said lock pin between said first position and said second position, wherein said rocker arm oil passage is elongated in a circumferential direction relative to said lock bore; and a rocker arm socket in said rocker arm body for receiving a lash adjuster of said internal combustion engine, wherein said rocker arm oil passage extends between said rocker arm socket and said lock bore;

wherein said lock bore comprises:

a lock bore first section that is distal from said follower;

a lock bore second section that is proximal to said follower and has a different diameter than said lock bore first section; and a lock bore third section that is coaxial with, and axially between, said lock bore first section and said lock bore second section and said lock bore third section has a diameter that is different than said lock bore first section and said lock bore second section;

wherein said rocker arm oil passage is located entirely between said lock bore first section and said lock bore second section; and wherein said follower is a high lift follower which transmits high lift valve opening and closing motion to said combustion valve when said lock pin is positioned to prevent relative movement between said rocker arm body and said high lift follower, said rocker arm further comprising:

a low lift follower which follows a second lobe of said camshaft and is mounted to said rocker arm body such that said low lift follower transmits low lift valve opening and closing motion or no valve opening and closing motion to said combustion valve when said lock pin is positioned to permit relative movement between said rocker arm body and said high lift follower.

7. A rocker arm as in claim 6 wherein:

said lock bore third section is smaller in diameter than said lock bore first section and;

said lock bore third section is larger in diameter than said lock bore second section.

8. A rocker arm as in claim 6 wherein said rocker arm oil passage is non-circular.

9. A rocker arm as in claim 8 wherein said rocker arm oil passage is defined by opposing semicircular end walls which are connected by opposing substantially straight sidewalls.

10. A rocker arm as in claim 6 wherein said rocker arm oil passage is defined by two or more cylindrical oil passages.

* * * * *